US007187894B2

(12) United States Patent
Fuma

(10) Patent No.: US 7,187,894 B2
(45) Date of Patent: Mar. 6, 2007

(54) IMAGE FORMING APPARATUS HAVING A HEAT BELT

(75) Inventor: Hiroshi Fuma, Uenohara-machi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 156 days.

(21) Appl. No.: 10/992,006

(22) Filed: Nov. 17, 2004

(65) Prior Publication Data

US 2005/0226660 A1 Oct. 13, 2005

(30) Foreign Application Priority Data

Apr. 9, 2004 (JP) ..... 2004-115043

(51) Int. Cl.
*G03G 15/20* (2006.01)

(52) U.S. Cl. ..... 399/320; 399/327; 399/328; 399/330; 399/331

(58) Field of Classification Search ..... 399/122, 399/320, 321, 324, 328
See application file for complete search history.

(56) References Cited

U.S. PATENT DOCUMENTS 5,950,060 A * 9/1999 Isogai ..... 399/324
5,999,779 A * 12/1999 Takeuchi ..... 399/239
6,782,231 B2 * 8/2004 Fuma et al. ..... 399/328
2002/0044805 A1 * 4/2002 Hasegawa ..... 399/325
2004/0022552 A1 * 2/2004 Yura et al. ..... 399/69
2005/0117942 A1 * 6/2005 Ishii et al. ..... 399/328

FOREIGN PATENT DOCUMENTS

JP 10-254266 9/1998
JP 11-038802 2/1999
JP 11-052768 2/1999
JP 2002-031968 A 1/2002

* cited by examiner

*Primary Examiner*—David M. Gray
*Assistant Examiner*—David A Blackshire
(74) *Attorney, Agent, or Firm*—Frishauf, Holtz, Goodman & Chick, P.C.

(57) ABSTRACT

There is provided an image forming apparatus having an image forming section for forming an unfixed image on a transfer medium and a fixing device for fixing the unfixed image by sandwiching and heating the transfer medium that holds the unfixed image, wherein, the fixing device includes a fixing roller that contacts with the unfixed image, a press roller that contacts with the fixing roller, a heat belt that contacts with the fixing roller and heats the fixing roller, a plurality of support rollers for supporting the heat belt in such a manner that the heat belt is wound around the support rollers, a heat source for heating the heat belt, and a press member for pressing the heat belt against the fixing roller in a portion of the contact area where the fixing roller and the heat belt contact with each other.

6 Claims, 3 Drawing Sheets

IMAGE FORMING APPARATUS HAVING A HEAT BELT

FIELD OF THE INVENTION

The present invention relates to an image forming apparatus including a fixing device used for image forming by copy machines, printers, facsimiles, and the like.

BACKGROUND OF THE INVENTION

As a fixing device used for an electrophotographic image forming apparatus such as a copy machine, a printer, or a facsimile, conventionally, a roller fixing device has been widely used which is by a heat roller fixing method. In the method, a fixing rubber roller, the fixing rubber roller having an elastic layer and maintained at a predetermined temperature, and a press rubber roller, the press rubber roller having an elastic layer and in press contact with the fixing rubber roller, heat a transfer medium on which an unfixed toner image has been formed, while sandwiching and conveying the transfer medium.

However, with this type of roller fixing device, since the fixing rubber roller has a large thermal resistance and a large thermal capacity, warming up of the apparatus takes a long time, and the inner portion of the elastic layer rises in temperature, shortening the life of the fixing rubber roller.

Further, color images often have a large solid area, which is mostly in a color other than black, having a problem that a glaze mark, if there is, stands out.

For color image fixing requiring high glaze uniformity, a fixing member needs elasticity at a part in contact with an image so that a fixing pressure is evenly applied. Therefore, a fixing roller of a metal core roller formed with a rubber layer around the circumference has been used as the fixing member.

Specifically, a fixing device is disclosed which allows fixing of color toner without applying oil and seldom causes offset (see Patent Document 1).

There is also disclosed a fixing device which efficiently heats a heat fixing roller with an external heating unit from outside, and prevents, as much as possible, the fixing roller from dropping in temperature due to contact with a recording sheet or the like (see Patent Document 2).

There is further known a heat fixing device which prevents a sudden drop in the surface temperature of a heat fixing member just after rotation start, thus causes no fixing failure of a toner image even setting the surface temperature of the heat fixing member during waiting time to a low value, thereby always achieving a fixed image with high quality (Patent Document 3).

[Patent Document 1] TOKKAIHEI No. 10-254266

[Patent Document 2] TOKKAIHEI No. 11-52768

[Patent Document 3] TOKKAIHEI No. 11-38.802

However, in the above fixing devices, heat supply amount increases with speedup, the temperature difference between the surface of a rubber layer having a low thermal conductivity and the boundary surface of a metal core becomes further greater, and thus the durability of rubber at the boundary surface greatly degrades.

To avoid this problem, increasing the thermal conductivity of the rubber layer and using a large sized roller may be considered, but it is limited technically, in cost, or in practice.

Therefore, a method has been offered by which the surface of a fixing roller is heated, not from a metal core, but with an external heat roller or the like. However, in this method, it is difficult to make the contact area large, and also, the thermal capacity of the external heat roller increases, having a problem of incapability for shortening a preliminary heating time. Further, improved technologies as solution of these problems have been offered, but not satisfactory.

The invention solves the above described problems, and has an object to provide an image forming apparatus having a fixing device with high productivity, durability performance, and the stability of image quality.

SUMMARY OF THE INVENTION

The above object of the invention can be attained by a structure described below.

An image forming apparatus of the invention can be attained by any one of the following structures.

(1) An image forming apparatus includes an image forming section for forming an unfixed image on a transfer medium, a fixing device for fixing the unfixed image by sandwiching and heating the transfer medium holding the unfixed image, wherein the fixing device has a fixing roller that contacts with the unfixed image, a press roller that contacts with the fixing roller, a heat belt that contacts and heats the fixing roller, a plurality of support rollers for supporting the heat belt in such a manner that the heat belt is wound around the support rollers, a heat source for heating the heat belt, and a press member for pressing the heat belt against the fixing roller in a portion of a contact area where the fixing roller and the heat belt contact with each other.

(2) The image forming apparatus of above item (1), wherein at least one of the plural support rollers also serves as the press member.

(3) The image forming apparatus of above item (1), wherein the fixing roller has a rubber layer at the outer circumference.

(4) The image forming apparatus of above item (1), wherein the pressure distribution in the contact area where the fixing roller and the heat belt contact with each other is asymmetric in the heat belt running direction, and the pressure is higher on the upstream side in the heat belt running direction.

(5) The image forming apparatus of item (1), wherein a spring energizes the press member at each end thereof so that the press member presses the heat belt against the fixing roller.

(6) The image forming apparatus of above item (1), wherein at least one of the plural support rollers is a wire roller formed by stretching wires in a roller shape.

(7) The image forming apparatus of above item (1), wherein the image forming section forms the unfixed image in color on the transfer medium.

With the above structures, the invention aims to provide image forming apparatuses having a fixing device with high productivity, durability performance, and the stability of image quality.

In above items (1) to (5), a pressure is applied at the entrance of a belt nip section, thereby tight contactness is improved over the entire area of the belt nip section, and thus, it is possible to provide an image forming apparatus having a fixing device with high productivity, durability performance, and the stability of image quality.

In item (6), with a wire roller as a roller only for supporting a heat belt, a low thermal capacity can be attained, and thus, it is possible to provide an image forming apparatus having a fixing device with high productivity, durability performance, and the stability of image quality.

In item (7), by using a belt with a built-in heater as an external heating unit, it is possible to provide a color-image forming apparatus having a fixing device with high productivity, durability performance, and the stability of image quality.

PREFERRED EMBODIMENTS OF THE INVENTION

In the following, preferred embodiments of the invention will be described. The description here does not limit the technical scope of the claims or the meanings of terms. The following affirmative description in the embodiments of the invention shows the best mode, and does not limit the meanings of the terms or the technical scope of the invention.

(1) An image forming apparatus provided with a fixing device having a heat belt in accordance with the invention will be described referring to FIG. 1.

Figure 1:
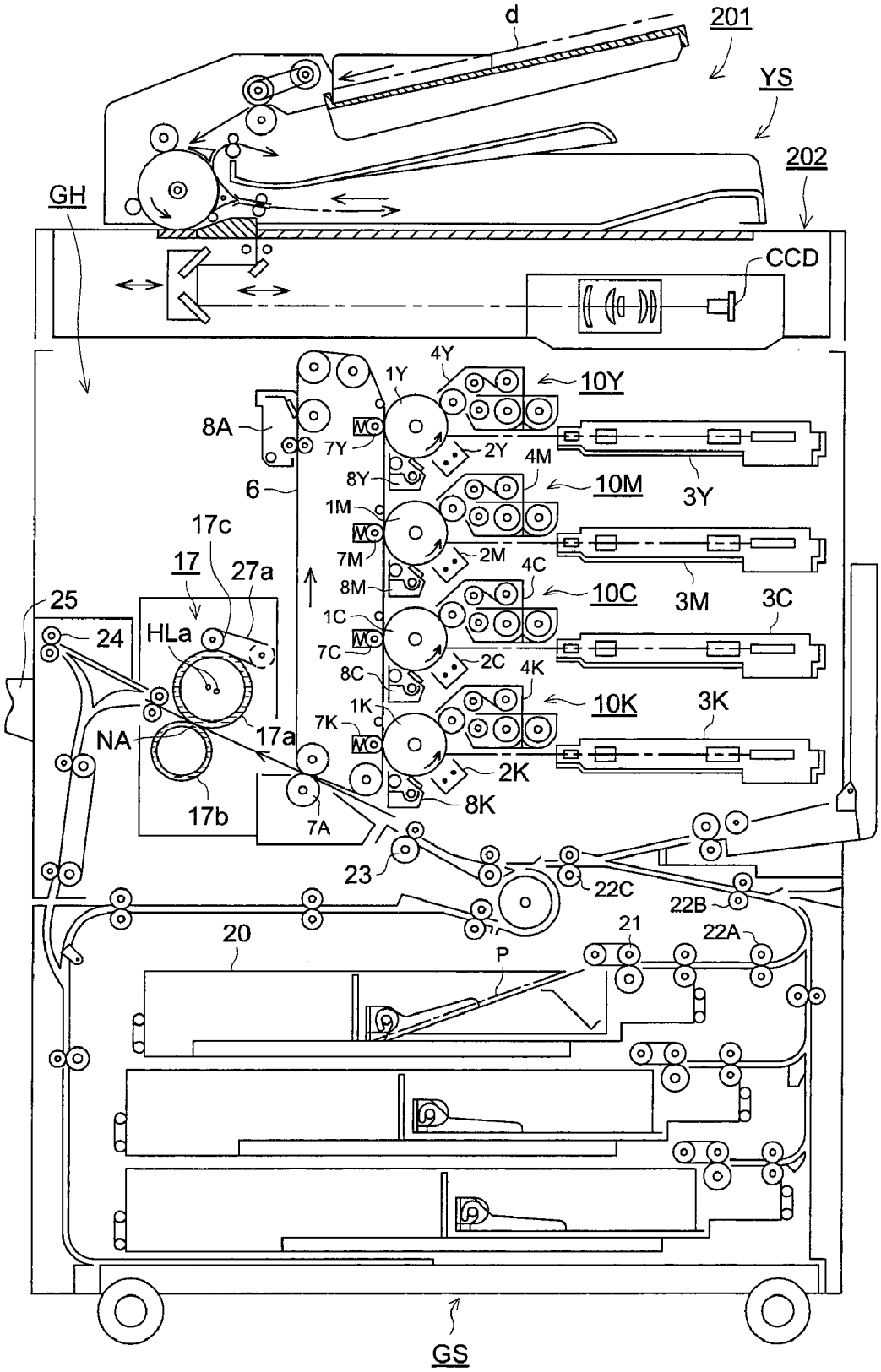
FIG. 1 is a schematic cross-sectional structural view of an image forming apparatus provided with a fixing device having a heat belt in accordance with the invention.

In FIG. 1, an image forming apparatus GS includes an image forming basic device GH and an image reading device YS.

The image forming basic device GH is called a tandem-type color image forming device and includes a plurality of image forming sections 10Y, 10M, 10C, and 10K, an intermediate transferrer 6 in a belt shape, a sheet conveying unit, and a fixing device 17 having a separation assisting unit described later.

On the top of the image forming basic device GH, there is provided the image reading device YS including an automatic original feeding device 201 and an original image scanning exposure device 202. An original d mounted on an original table of the automatic original feeding device 201 is conveyed by a conveying unit, then, an image on one side or images on two sides of the original are scan-exposed by an optical system of the original image scanning exposure device 202 and read by a line image sensor CCD.

Analogue signals photo-electrically converted by the line image sensor CCD are subjected in an image processing section to an analogue process, A/D conversion, shading adjustment, an image compression process, and the like, and then transmitted to image writing sections (exposure units) 3Y, 3M, 3C, and 3K.

The image forming section 10Y for forming a yellow (Y) colored image includes an electric charging unit 2Y, an exposure unit 3Y, a developing device 4Y, and a cleaning unit 8Y disposed around a photoreceptor drum 1Y as an image carrier. The image forming section 10M for forming a magenta (M) colored image includes a photoreceptor drum 1M as an image carrier, an electric charging unit 2M, an exposure unit 3M, a developing device 4M, and a cleaning unit 8M. The image forming section 10C for forming a cyan (C) colored image includes a photoreceptor drum 1C as an image carrier, an electric charging unit 2C, an exposure unit 3C, a developing device 4C, and a cleaning unit 8C. The image forming section 10K for forming a black (K) colored image includes a photoreceptor drum 1K as an image carrier, an electric charging unit 2K, an exposure unit 3K, a developing device 4K, and a cleaning unit 8K. The electric charging unit 2Y and the exposure unit 3Y, the electric charging unit 2M and the exposure unit 3M, the electric charging unit 2C and the exposure unit 3C, and the electric charging unit 2K and the exposure unit 3K form a latent image forming unit.

The devices 4Y, 4M, 4C, and 4K are developing devices containing a two-component developing agent made of a toner of small particles and a carrier respectively for yellow (Y), magenta (M), cyan (C), and black (K).

The intermediate transferrer 6 is wound around a plurality of rollers and circulatively supported them.

Images in the respective colors formed by the image forming sections 10Y, 10M, 10C, and 10K are primarily transferred in sequence onto the circulating intermediate transferrer 6 by a transfer device 7Y, 7M, 7C, and 7K, and then a synthesis color image is formed. A recording sheet P as a transfer medium stored in a sheet feeding cassette 20 is fed by a sheet feeding device 21 and conveyed through sheet feeding rollers 22A, 22B, 22C, a registration roller 23, etc. to a transfer device 7A, then the color image is secondarily transferred onto the recording sheet P. The recording sheet P with the color image having been transferred thereon is conveyed to a fixing device 17.

The fixing device 17 includes a fixing roller 17*a* having a built-in halogen heater HLa as a heat source and a press roller 17*b*. The fixing device 17 presses and heats the unfixed image on the recording sheet P at a fixing nip section NA between the rollers. A heat belt 27*a* is in contact with a portion of the circumference of the fixing roller 17*a*. Inside the heat belt 27*a*, there is provided a heat roller 17*c* that is a press member for pressing the heat belt 27*a* against the fixing roller 17*a* in a portion of a contact area where the fixing roller and the heat belt contact with each other, wherein a spring member energizes the press member at each end of the rotation shaft thereof so that the press member presses the heat belt against the fixing roller. The fixing device 17 applies a heat and a pressure to the recording sheet P, thereby the color image is fixed on the recording sheet P. The recording sheet P is sandwiched by exit rollers 24 to be mounted on an exit tray 25.

On the other hand, after the color image is transferred to the recording sheet P by the transfer device 7A, residual toner on the intermediate transferrer 6 having parted from the recording sheet P is removed by a cleaning device 8A.

Although in the description of the above image forming apparatus, color image forming has been described, but the invention also includes cases of monochrome image forming.

(2) Fixing devices in accordance with the invention will be described below referring to FIGS. 2 to 4.

Figure 2:
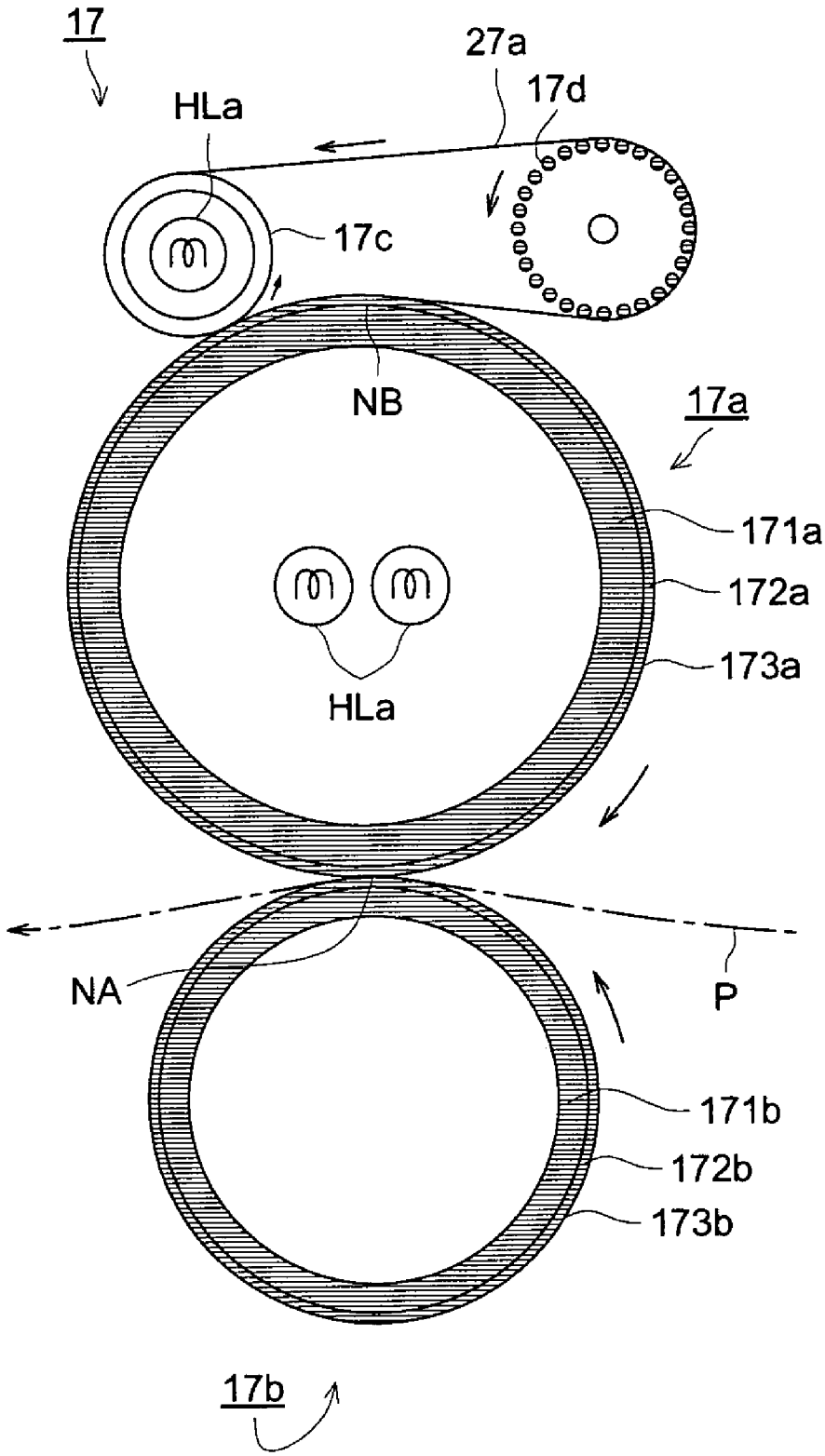
FIG. 2 is a schematic cross-sectional view of the fixing device having the heat belt in accordance with the invention.
Figure 3:
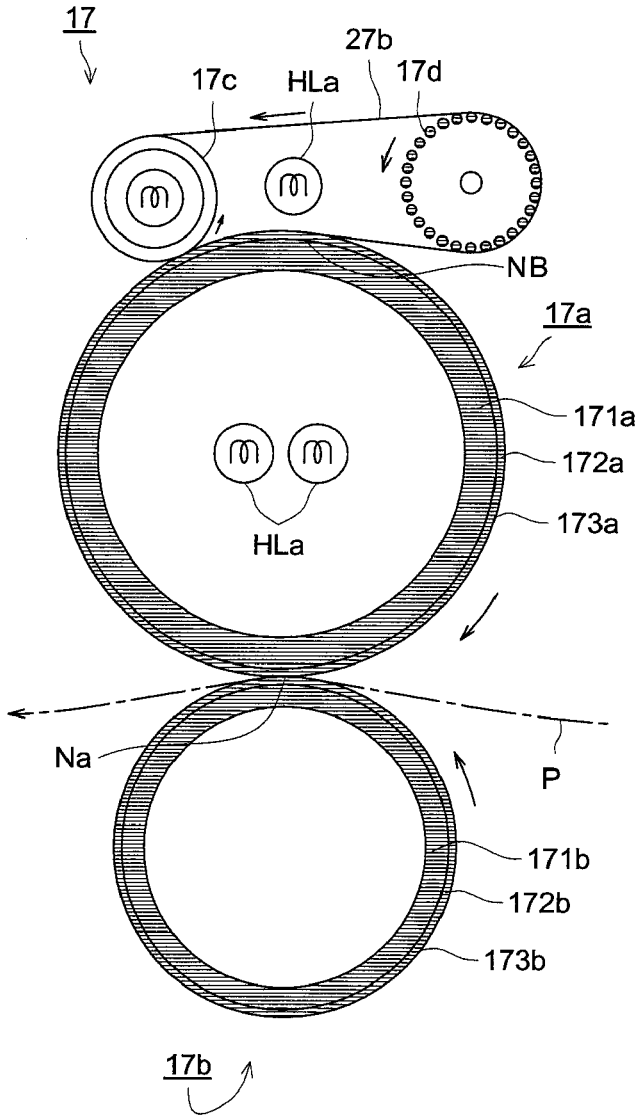
FIG. 3 is a schematic cross-sectional view of another fixing device having a heat belt in accordance with the invention.

FIG. 2 is a schematic cross-sectional view of a fixing device having a heat belt in accordance with the invention. FIG. 3 is a schematic cross-sectional view showing another example of a fixing device having a heat belt in accordance with the invention. FIG. 4 is a pressure distribution of a heat belt against a fixing roller.

A fixing device 17 in accordance with the invention has a structure shown in FIG. 2 including a fixing roller 17*a* with a built-in halogen heater HLa as a heat source, a press roller 17*b*, a heat belt 27*a* arranged on the periphery of the fixing roller 17*a*, and a plurality of support rollers for supporting the heat belt in such a manner that the heat belt is wound around the support rollers. A fixing nip section NA is formed between the fixing roller 17*a* and the press roller 17*b*, and a belt nip section NB is formed between the heat belt 27*a* and the fixing roller 17*a*. Inside the heat belt 27*a*, there is provided a heat roller 17*c* which is a press member for pressing a part of an area where the heat belt 27*a* and the fixing roller 17*a* contact each other. The heat roller 17*c* is one of the plural support rollers for supporting the heat belt 27*a* in such a manner that the heat belt is wound around the support rollers, and serves as both a support roller and a press member.

The heat belt 27*a* is supported by the heat roller 17*c* being a metal roller having a built-in halogen heater HLa as a heat source and a support roller 17*d* being a wire roller formed in a roller shape by stretching wires. The heat roller 17*c* is utilized as the press member for pressing the heat belt against the fixing roller in a portion of a contact area where the fixing roller and the heat belt contact with each other. In addition to supporting the heat belt 27*a*, the heat roller 17*c* has a function to press the heat belt 27*a* against the fixing roller 17*a* at the entrance of the belt nip section NB so that the heat belt 27*a* tightly contacts with the fixing roller 17*a* and a function to transfer heat supplied by the halogen heater HLa to the heat belt 27*a* wound on the fixing roller 17*a* so that the heat belt 27*a* is heated. The heat belt 27*a* is pressed by the heat roller 17*c* to tightly contact with the fixing roller 17*a*, which enables enough heat transfer even in an area downstream therefrom where the heat belt 27*a* is wound. The support roller 17*d* is constructed with wires to achieve a low heat capacity. Therefore, the support roller 17*d* has an extremely low heat capacity and low thermal conductivity, and thus, drop in thermal control performance due to increase in the heat capacity and heat flowing out to the image recording basic device through a bearing and the like can be reduced.

The heat belt 27*a* has a main body and a releasing layer, at the surface, for reducing failure of contact with the fixing roller 17*a* due to surface dirt. As the main body, a metal belt of nickel or stainless steel with a thickness of 20 to 100 μm, or a heat-resisting resin belt of polyimide or the like with a thickness of 50 to 300 μm is preferable. The releasing layer is preferably coating or a tube of PFA, PTFE, or the like. In the present embodiment, a PTFE layer with a thickness of 30 μm is arranged on a main body of polyimide with a thickness of 150 μm.

The heat roller 17*c* has a built-in halogen heater HLa, which is the heat source. The heat belt 27*a* contacts with the heat roller 17*c*, thereby being heated. In the present embodiment, an aluminum pipe with a diameter ϕ of 20 mm and a wall thickness of 1 mm is employed as the heat roller 17*c* which presses the fixing roller 17*a* through the heat belt 27*a* with a force of 100 N. With this pressing, the heat belt 27*a* and the fixing roller 17*a* are in tight contact, and thus, heat is transferred from the heat belt 27*a* to the fixing roller 17*a* with high efficiency. Also with this pressing force, the heat belt 27*a* is driven to rotate by the rotation of fixing roller 17*a*.

At least one of the support rollers for supporting the heat belt 27*a* is a wire roller formed in a roller shape by stretching wires. The support roller 17*d* for supporting the heat belt 27*a* is formed by stretching wires of a heat resisting resin or a metal between flanges supported by the both ends of the rotation shaft into a basket type wire roller as shown in FIG. 4 of TOKKAI No. 2002-31968.

The tight contactness between the fixing roller 17*a* and the heat belt 27*a* is secured by the pressing force of the heat roller 17*c* at the entrance of the belt nip section NB, which allows the tension of the heat belt 27*a* to be as low as 5 to 30 N. Therefore, almost no mechanical strength is required for the support roller 17*d*, and the heat capacity and the heat conductivity are extremely low. Thus, an extra heat amount for heating the support roller 17*d* and heat radiation through the support roller 17*d* are negligible, and the warming-up time can be shortened, reducing consumption electric power.

Compared to a case of using an external heat roller, the contact time between the heat belt and the fixing roller at the nip section can be much longer, achieving high efficiency of heat transfer. The required heat supply capacity is dependent on the linear velocity, the temperature that is set for the fixing roller, and the like. Therefore, the size of the heat roller and the thickness of the belt are properly set based on experiment and the like.

The fixing roller 17*a* is constructed as a soft roller with an outer diameter of 20 to 50 mm formed by a cylindrical metal pipe 171*a* with a wall thickness of 2 to 5 mm, the metal being a steel such as SKTM (carbon pipe for mechanical structure), a silicon rubber layer 172*a* with a thickness of 0.5 to 5 mm on the circumferential surface of the metal pipe 171*a*, and further a PFA (perfluoroalkoxy) tube 173*a* with a thickness of 30 to 70 μm around the silicon rubber layer 172*a*.

The press roller 17*b* is constructed as a soft roller with an outer diameter of 40 to 80 mm formed by a cylindrical metal pipe 171*b* with a wall thickness of 2 to 5 mm, the metal being a steel such as SKTM (carbon tube for mechanical structure) or aluminum, a silicon rubber layer 172*b* with a thickness of 1 to 3 mm on the circumferential surface of the metal pipe 171*b*, and further a releasing layer 173*b* formed by coating PFA (perfluoroalkoxy) with a thickness of 30 to 70 μm around the silicon rubber layer 172*b*.

In the above example, heat amount supplied from the heat belt 27*a* to the fixing roller 17*a* is dependent on the heat capacity of the heat belt 27*a*. In the case where the heat amount is short due to the thickness set for the heat belt 27*a*, the halogen heater HLa is arranged, as shown in FIG. 3, so that the halogen heater HLa emits heat to the inner face of the heat belt 27*a* corresponding to the belt nip section NB between the heat belt 27*a* and the fixing roller 17*a*. Thus, heat can be supplied to the heat belt 27*a* from which the fixing roller 17*a* has taken out heat, which enables heat supply with a more efficient use of the wide belt nip section NB. In this case also, since the tight contactness at the entrance of the belt nip section NB is secured, the heat transfer efficiency from the heat belt 27*a* to the fixing roller 17*a* is secured.

Figure 4:
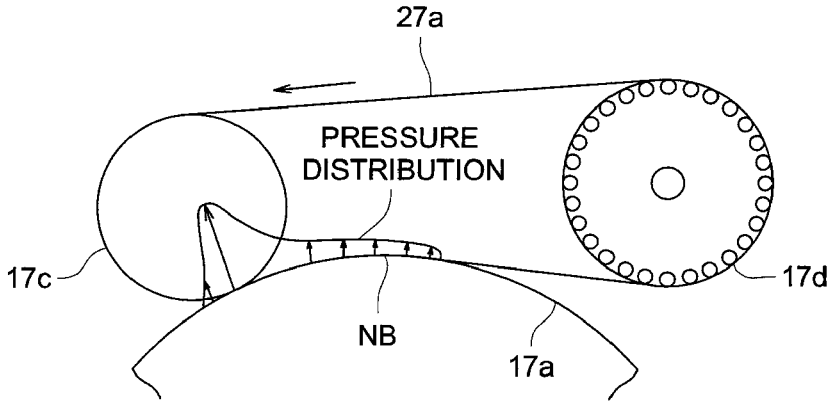
FIG. 4 shows a pressure distribution of the heat belt against the fixing roller.

In the above fixing device 17, the pressure distribution in the contact area where the fixing roller 17*a* and the heat belt 27*a* contact with each other is, as shown in FIG. 4, asymmetric in the running direction of the heat belt 27*a*, wherein the pressure on the upstream side in the running direction of the heat belt 27*a* is set higher. The high pressure area is formed by contact of the heat roller 17*c* being the press member.

Whether to arrange the halogen heater HLa being a heat source in both the heat roller 17*c* and the heat belt 27*a* or either of them is to be properly determined according to the required heat supply amount, complexity of mechanical structure, cost, etc. The halogen heater HLa being a heat source may be arranged outside the heat belt 27*a*. In a case where the heater is arranged in the heat roller 17*c*, the temperature of the heat roller 17*c* can be detected by a sensor and controlled, while in a case where the heater is arranged inside the heat belt 27*a*, it is necessary to install a safety mechanism including a sensor for abnormality detection to prepare for the case of abnormality such that the heat belt 27*a* does not rotate.

The toner image held by the recording sheet P having been conveyed to a fixing area by a sheet feeding guide (not shown) is fixed on the recording sheet P through pressing and heating by the fixing roller 17*a* and the press roller 17*b*. As the toner layer contacts with rubber, directly or through an extremely thin releasing layer, the rubber deforms following irregularities of the recording sheet P and the toner layer, and uniformly contacts them, thereby uniform fixing without uneven gloss is performed so that the toner image maintains a proper glossiness. After fixing, the recording sheet P having parted from the fixing roller 17*a* is ejected outside the fixing device 17.

On the outer circumference of the fixing roller 17*a*, heat is supplied from the heat belt 27*a* with higher heat transfer efficiency than the external heat roller mentioned at the beginning. Therefore, in the case where continuous sheet feeding is started after the temperature has risen and the temperature gradient inside the fixing roller 17*a* has become small through waiting, drop in surface temperature of the fixing roller 17*a* is reduced to be smaller, reducing changes in image quality such as glossiness. Further, also during stable continuous fixing, the required heat quantity to be supplied from inside the fixing roller 17*a* is even less than the case of using an external heat roller. Thus, the temperature gradient inside the fixing roller 17*a* is smaller, and the temperature at the boundary surface between the rubber layer and the core metal is lower, extending the durability of the fixing roller 17*a*.

As described above, with a structure in accordance with the present invention, an image forming apparatus can be provided having a fixing device with high productivity, durability performance, and the stability of image quality.

What is claimed is:

1. An image forming apparatus comprising:

an image forming section for forming an unfixed image on a transfer medium; and a fixing device for fixing the unfixed image by sandwiching and heating the transfer medium on which the unfixed image is formed, wherein the fixing device comprises:

a fixing roller that contacts the unfixed image;

a press roller that contacts the fixing roller via the transfer medium;

a heat belt that contacts the fixing roller and heats the fixing roller;

a plurality of support rollers that support the heat belt such that the heat belt is wound around the support rollers;

a heat source that heats the heat belt; and means for pressing the heat belt against the fixing roller in a portion of a contact area where the fixing roller and the heat belt contact each other;

wherein pressure distribution in the contact area where the fixing roller and the heat belt contact each other is asymmetric in a running direction of the heat belt, and pressure is higher at an upstream side in the running direction of the heat belt.

2. The image forming apparatus of claim 1, wherein the means for pressing comprises at least one of the plurality of support rollers.

3. The image forming apparatus of claim 1, wherein the fixing roller comprises a rubber layer at an outer circumference thereof.

4. The image forming apparatus of claim 1, wherein a spring energizes the means for pressing at each end thereof so that the means for pressing presses the heat belt against the fixing roller.

5. The image forming apparatus of claim 1, wherein at least one of the support rollers comprises a wire roller formed by stretching at least one wire in a roller shape.

6. The image forming apparatus of claim 1, wherein the image forming section forms the unfixed image in color on the transfer medium.

* * * * *